US012808125B2

(12) United States Patent
Wakabayashi et al.

(10) Patent No.: US 12,808,125 B2
(45) Date of Patent: Nov. 24, 2026

(54) GAS BARRIER LAMINATE AND PACKAGING

(71) Applicant: TOPPAN Holdings Inc., Tokyo (JP)

(72) Inventors: Hiroyuki Wakabayashi, Tokyo (JP); Junichi Kaminaga, Tokyo (JP); Yoshiki Koshiyama, Tokyo (JP); Yumiko Kojima, Tokyo (JP); Rika Ishii, Tokyo (JP)

(73) Assignee: TOPPAN Holdings Inc., Tokyo (JP)

( * ) Notice: Subject to any disclaimer, the term of this patent is extended or adjusted under 35 U.S.C. 154(b) by 177 days.

(21) Appl. No.: 18/681,634

(22) PCT Filed: Aug. 8, 2022

(86) PCT No.: PCT/JP2022/030320

§ 371 (c)(1),
(2) Date: Feb. 6, 2024

(87) PCT Pub. No.: WO2023/017812

PCT Pub. Date: Feb. 16, 2023

(65) Prior Publication Data

US 2024/0344273 A1 Oct. 17, 2024

(30) Foreign Application Priority Data

Aug. 12, 2021 (JP) ..... 2021-131614

(51) Int. Cl.

| | |
|---|---|
| ***D21H 19/22*** | (2006.01) |
| ***B65D 65/42*** | (2006.01) |
| ***D21H 19/82*** | (2006.01) |
| ***D21H 23/44*** | (2006.01) |

(52) U.S. Cl.
CPC ..... *D21H 19/82* (2013.01); *B65D 65/42* (2013.01); *D21H 19/22* (2013.01); *D21H 23/44* (2013.01)

(58) Field of Classification Search
None
See application file for complete search history.

(56) References Cited

U.S. PATENT DOCUMENTS

2016/0325902 A1* 11/2016 Björk ..... B32B 27/08
2020/0094535 A1* 3/2020 Schäfer ..... B32B 27/08

FOREIGN PATENT DOCUMENTS

| | | | |
|---|---|---|---|
| JP | 2006026945 A | * | 2/2006 |
| JP | 2020-069783 | | 5/2020 |
| JP | 2021-035753 | | 3/2021 |
| JP | 2021-091108 | | 6/2021 |
| JP | 2021-094751 A | | 6/2021 |
| JP | 3233001 | | 7/2021 |

(Continued)

OTHER PUBLICATIONS

Machine translation of JP 3233001 (Year: 2021).*

(Continued)

*Primary Examiner* — Ramsey Zacharia
(74) *Attorney, Agent, or Firm* — Studebaker Brackett PLLC

(57) ABSTRACT

A gas barrier laminate having a laminate structure including a paper base material and a transparent vapor-deposited layer, in which the paper base material has a maximum light transmittance of 0.85% or more for a light beam having at least one wavelength among light beams having a wavelength within a range of 300 nm to 800 nm.

19 Claims, 2 Drawing Sheets

(56) References Cited

FOREIGN PATENT DOCUMENTS

| | | | | |
|---|---|---|---|---|
| WO | WO 2020/138206 | A1 | 7/2020 | |
| WO | WO-2022058724 | A1 * | 3/2022 | ..... B32B 15/08 |
| WO | 2022/071399 | A1 | 4/2022 | |

OTHER PUBLICATIONS

Machine translation of JP 2021-091108 (Year: 2020).*
Machine translation of JP 2006-026945 A (Year: 2006).*
International Search Report issued in International Application No. PCT/JP2022/030320 dated Sep. 27, 2022.
English Translation of IPRP (PCT/IB/338 and PCT/IB/373) (Feb. 22, 2024 and Feb. 13, 2024) and Written Opinion of ISA (PCT/ISA/237) issued in counterpart International Application No. PCT/JP2022/030320 on Sep. 27, 2022 (7 pages).
The extended European search report issued by the European Patent Office on Nov. 28, 2024, which corresponds to European Patent Application No. 22855874.8-1102 and is related to U.S. Appl. No. 18/681,634.

* cited by examiner

GAS BARRIER LAMINATE AND PACKAGING

CROSS-REFERENCE TO RELATED APPLICATIONS

This application is a 35 U.S.C. § 371 national phase application of PCT/JP2022/030320, filed on Aug. 8, 2022, which claims priority to Japanese Patent Application No. 2021-131614, filed on Aug. 12, 2021, the contents of all of which are incorporated herein by reference.

TECHNICAL FIELD

The present disclosure relates to a gas barrier laminate and a packaging bag including the same.

BACKGROUND ART

In many fields of food, beverages, pharmaceuticals, chemicals and the like, packaging materials suitable for individual contents are being used. Packaging materials are required to have properties of preventing the permeation of water vapor or the like, which causes a change in the properties of the contents, (gas barrier properties). In recent years, due to the growing environmental awareness that is inspired by the ocean plastic trash issue or the like, the momentum for plastic-free world has been growing. From the viewpoint of reducing the amount of plastic materials used, studies are underway to use paper instead of plastic materials in a variety of fields.

Patent Literature 1 discloses a gas barrier laminate having a water vapor barrier layer and a gas barrier layer in this order on the surface of a paper support. Patent Literature 2 discloses a paper laminate having a resin layer on at least one surface of a paper base material and a vapor-deposited layer having a thickness of 1 to 1000 nm on the resin layer, in which the resin layer contains a water-suspended polymer and a plate-like inorganic compound having an aspect ratio of 80 or more.

CITATION LIST

Patent Literature

[Patent Literature 1] Japanese Unexamined Patent Publication No. 2020-69783

[Patent Literature 2] Japanese Unexamined Patent Publication No. 2021-035753

SUMMARY OF INVENTION

Technical Problem

In order to provide a gas barrier laminate having stable gas barrier properties, conventionally, the film thickness management of a gas barrier layer formed by vapor deposition (hereinafter, also referred to as "vapor-deposited layer" in some cases) has been performed. That is, the film thickness management of a vapor-deposited layer has been performed by a method in which, for example, the light transmittances of the UV-Vis region are measured before and after the formation of the vapor-deposited layer on a base material film and the degree of the light transmittance decreased by the formation of the vapor-deposited layer is ascertained.

For plastic films that have been conventionally used as base material films, the film thickness management of vapor-deposited layers by the above-described method is possible since the light transmittance of the UV-Vis region is almost 100%. However, in the case of using paper base materials instead of plastic base material films, it is not possible to apply the conventional film thickness management method as it is since the paper base materials ordinarily have a low light transmittance, and the present inventors found a new problem in that there is a need to select a specific kind of paper base material as a paper base material to be used.

The present disclosure provides a gas barrier laminate that realizes the reduction in the amount of plastic materials used by the use of a paper base material and has stable gas barrier properties by the film thickness management of a vapor-deposited layer in the manufacturing process and a packaging bag including the same.

Solution to Problem

A gas barrier laminate according to the present disclosure has a laminate structure including a paper base material and a transparent vapor-deposited layer, and the paper base material has a maximum light transmittance of 0.85% or more for a light beam having at least one wavelength among light beams having a wavelength within a range of 300 nm to 800 nm.

According to the present inventors' studies, selection of a paper base material satisfying the above-described condition makes it possible to perform the film thickness management of a transparent vapor-deposited layer by a method in which the degree of the light transmittance decreased by the formation of the transparent vapor-deposited layer on the paper base material is ascertained. As the paper base material satisfying such a condition, glassine paper, paraffin paper and parchment paper can be exemplified. However, the paper base material is not limited thereto as long as the paper base material satisfies the above-described condition.

A packaging bag according to the present disclosure includes the gas barrier laminate. This packaging bag may have a bent part. The paper base material has crease retention (also referred to as dead fold properties) and thus has a feature of being easy to process.

Advantageous Effects of Invention

According to the present disclosure, a gas barrier laminate that realizes the reduction in the amount of plastic materials used by the use of a paper base material and has stable gas barrier properties by the film thickness management of a vapor-deposited layer in the manufacturing process and a packaging bag including the same are provided.

DESCRIPTION OF EMBODIMENTS

Hereinafter, an embodiment of the present disclosure will be described in detail with reference to drawings in some cases. However, the present invention is not limited to the following embodiment.

<Gas Barrier Laminate>

Figure 1:
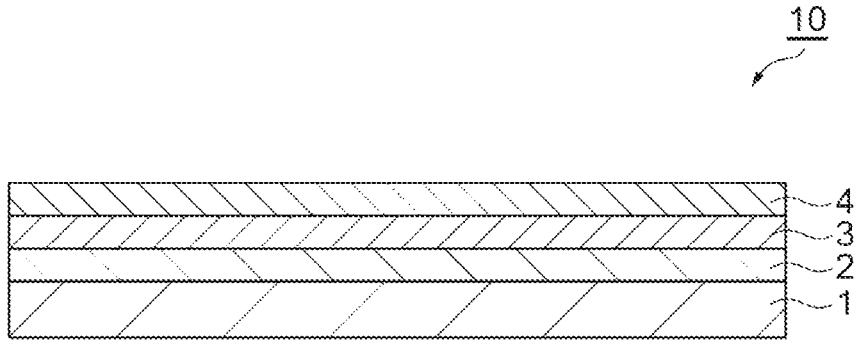
FIG. 1 is a cross-sectional view schematically showing one embodiment of a gas barrier laminate according to the present disclosure.

FIG. 1 is a cross-sectional view schematically showing a gas barrier laminate according to the present embodiment. A gas barrier laminate 10 shown in this drawing has a laminate structure including a paper base material 1, an anchor coat layer 2, a transparent vapor-deposited layer 3 and an overcoat layer 4 in this order. The paper base material 1 has a maximum light transmittance of 0.85% or more for a light beam having at least one wavelength among light beams having a wavelength within a range of 300 nm to 800 nm. When the paper base material 1 satisfies the above-described condition, the film thickness management of the transparent vapor-deposited layer 3 can be performed in the manufacturing process of the gas barrier laminate 10.

The gas barrier laminate 10 has excellent gas barrier properties. "Gas barrier properties" mentioned herein refer to a sufficiently low water vapor permeability. In the gas barrier laminate 10, the water vapor permeability at 40° C. and 90% RH is preferably 10 $g/m^2/d$ or less and may be 8 $g/m^2/d$ or less or 5 $g/m^2/d$ or less. In the case of accommodating contents that do not require advanced water vapor barrier properties, this value may exceed 10 $g/m^2/d$.

The gas barrier laminate 10 preferably maintains sufficient gas barrier properties even after being bent. When the gas barrier laminate 10 is bent with the paper base material 1 placed outside, a roller having a weight of 2 kg is rotated once on the gas barrier laminate 10 and the water vapor permeability (conditions: 40° C. and 90% RH) is then measured with the crease open, the water vapor permeability is preferably 12 $g/m^2/d$ or less. On the other hand, when the gas barrier laminate 10 is bent with the paper base material 1 placed inside, a roller having a weight of 2 kg is rotated once on the gas barrier laminate 10 and the water vapor permeability (conditions: 40° C. and 90% RH) is then measured with the crease open, the water vapor permeability is preferably 12 $g/m^2/d$ or less.

Hereinafter, each layer will be described.

[Paper Base Material]

Whether or not the paper base material 1 satisfies the above-described condition regarding the maximum light transmittance can be determined as described below. First, the light transmittance of the paper base material 1 is measured for all light beams having a wavelength within a range of 300 to 800 nm. In this measurement, a spectrophotometer UV-2450 (manufactured by Shimadzu Corporation) can be used (refer to the description of an experiment example regarding specific conditions). When a paper base material 1 satisfying such a condition is selected, the thin film management of the transparent vapor-deposited layer 3 in the manufacturing process becomes possible, and the gas barrier laminate 10 having stable gas barrier properties can be manufactured.

The value of the maximum light transmittance (0.85% or more) that the paper base material 1 should have regarding a light beam having at least one wavelength among light beams having a wavelength within the specific range has been set based on an experimental evaluation test by the present inventors. Examples of the paper base material that satisfies such a condition include glassine paper, paraffin paper and parchment paper. When this value is 0.85% or more, highly reliable film thickness management is possible, and a contribution can be made to the manufacturing of the gas barrier laminate 10 having stable gas barrier properties. This value is preferably 1.0% or more and may be 10.0% or more depending on, for example, the light transmittances of the anchor coat layer 2 and the transparent vapor-deposited layer 3. The upper limit value of this value is not particularly limited, but is approximately 70% from the viewpoint of the possibility of procuring the paper base material from the market.

The thickness of the paper base material 1 is, for example, 30 μm to 100 μm and may be 30 μm to 70 μm. Based on the total thickness of the gas barrier laminate 10, the proportion of the thickness of the paper base material 1 is preferably 70% or more, more preferably 80% or more and still more preferably 90% or more. When this proportion is 70% or more, the gas barrier laminate can be said to be excellent in terms of environmental suitability. Based on the total mass of the gas barrier laminate 10, the proportion of the mass of the paper base material 1 is preferably 50 mass % or more, more preferably 70 mass % or more and still more preferably 80 mass % or more. When this proportion is 50 mass % or more, it is possible to sufficiently reduce the amount of plastic materials used, the gas barrier laminate 10 can be said to be made of paper as a whole, and the recyclability is excellent. The thickness of the paper base material 1 means a value that is measured by the observation of a cut surface.

The paper base material 1 may have a coat layer (not shown) provided on the surface facing the anchor coat layer 2. The coat layer prevents the anchor coat layer 2 from infiltrating into the paper base material 1 and is capable of playing a role of a filler that fills unevenness on the surface of the paper base material 1. The coat layer contains, as a binder resin, for example, a variety of copolymers such as a styrene-butadiene-based copolymer, a styrene-acrylic copolymer and ethylene-vinyl acetate-based copolymer, a polyvinyl alcoholic resin, a cellulose-based resin, paraffin (WAX) or the like and contains, as a filler, for example, clay, kaolin, calcium carbonate, talc, mica or the like. A coat layer containing such a filler is referred to as "clay coat layer." The thickness of the clay coat layer is, for example, 1 μm to 10 μm and may be 3 μm to 8 μm.

The basis weight (mass per unit area) of the paper base material 1 is, for example, 20 $g/m^2$ to 100 $g/m^2$ and may be 30 $g/m^2$ to 70 $g/m^2$. When this value is 30 $g/m^2$ or more, the strength of the gas barrier laminate 10 is easily secured, and, on the other hand, when the value is 70 $g/m^2$ or less, the transparency of the paper base material 1 is easily secured.

[Transparent Vapor-Deposited Layer]

The transparent vapor-deposited layer 3 is a layer on which an inorganic compound is vapor-deposited. Examples of a material that configures the transparent vapor-deposited layer 3 include silicon oxide ($SiO_x$), aluminum oxide ($AlO_x$) and complexes thereof. "Being transparent" mentioned herein means being transparent with respect to visible light. The transparent vapor-deposited layer 3 is transparent, but the transmittance of visible light is not 100%. Therefore, the light transmittance of a laminate film after the formation of the transparent vapor-deposited layer 3 exhibits a low value compared with the laminate film before the formation of the transparent vapor-deposited layer 3.

The thin film management of the transparent vapor-deposited layer 3 is performed by, for example, in the case of manufacturing the gas barrier laminate 10 by roll-to-roll processing, measuring the light transmittances before and after the formation of the transparent vapor-deposited layer 3 and ascertaining the thickness of the transparent vapor-deposited layer 3 from the degree of the light transmittance decreased by the formation of the vapor-deposited layer 3. When a calibration curve showing the relationship between the actual measurement value of the thickness of the transparent vapor-deposited layer 3 and the degree of the light transmittance decreased is produced in advance, the thickness of the transparent vapor-deposited layer 3 can be accurately ascertained to a certain extent from the degree of the light transmittance decreased in the manufacturing process.

The thickness of the transparent vapor-deposited layer 3 may be set as appropriate depending on the intended use, but is preferably 30 nm or more and may be 50 nm or more and is preferably 100 nm or less and may be 80 nm or less. When the thickness of the transparent vapor-deposited layer 3 is 30 nm or more, it is easy to make the transparent vapor-deposited layer 3 sufficiently continuous, and, on the other hand, when the thickness is 100 nm or less, it is possible to sufficiently suppress the generation of curls or cracks, and sufficient gas barrier performance and flexibility are easily achieved. The thickness of the transparent vapor-deposited layer 3 means a value that is measured by fluorescent X-ray analysis.

The transparent vapor-deposited layer 3 is preferably formed by vacuum film-forming means from the viewpoint of oxygen gas barrier performance or film uniformity. As the film-forming means, there are well-known methods such as a vacuum vapor deposition method, a sputtering method and a chemical vapor deposition method (CVD method), but a vacuum vapor deposition method is preferable since the film-forming speed is fast, and the productivity is high. In addition, as the vacuum vapor deposition method, particularly, film-forming means by electron beam heating is effective since the film-forming speed is easily suppressed with the irradiation area, the electron beam current or the like or the temperature of a material to be vapor-deposited can be increased or decreased within a short period of time.

[Anchor Coat Layer]

The anchor coat layer 2 is provided on the surface of the paper base material 1 and is provided for improvement in the adhesiveness between the paper base material 1 and the transparent vapor-deposited layer 3 or improvement in the gas barrier properties of the gas barrier laminate 10. The anchor coat layer 2 is preferably excellent in terms of flexibility. In such a case, it is possible to suppress the cracking of the transparent vapor-deposited layer 3 after the gas barrier laminate 10 is bent.

Examples of a material that configures the anchor coat layer 2 include polyolefins having a polar group or polyvinyl alcohol-based resins. The polyolefins may have at least one selected from a carboxyl group, a salt of a carboxyl group, a carboxylic acid anhydride group and a carboxylic acid ester. When the anchor coat layer 2 contains the polyolefin, the anchor coat layer 2 is likely to be a dense film, and the water vapor barrier properties of the gas barrier laminate 10 can improve. The polyvinyl alcohol-based resins are, for example, a completely saponified polyvinyl alcohol resin, a partially saponified polyvinyl alcohol resin, a modified polyvinyl alcohol resin, an ethylene-vinyl alcohol copolymer resin and the like. The polyvinyl alcohol-based resins have excellent flexibility, are capable of suppressing the deterioration of the gas barrier properties by suppressing the cracking of the transparent vapor-deposited layer 3 after bending and are capable of improving the adhesiveness between the transparent vapor-deposited layer 3 and the anchor coat layer 2.

As the polyolefin having a polar group, a substance obtained by copolymerizing an unsaturated carboxylic acid (an unsaturated compound having a carboxyl group such as acrylic acid, methacrylic acid or a maleic anhydride) or an unsaturated carboxylic acid ester to ethylene or propylene, a salt obtained by neutralizing a carboxylic acid with a basic compound or the like may be used, and, additionally, a substance copolymerized with vinyl acetate, an epoxy-based compound, a chlorine-based urethane-based compound, a polyamide-based compound or the like or the like may also be used. Specific examples of the polyolefin having a polar group include copolymers of an acrylic ester and a maleic anhydride, ethylene-vinyl acetate copolymers, ethylene-glycidyl methacrylate copolymers and the like.

The content rate (based on the mass of the anchor coat layer 2) of the polyolefin or the polyvinyl alcohol-based resin in the anchor coat layer 2 is, for example, 50 mass % or more and may be 70 mass % or more, 90 mass % or more or 100 mass %. Examples of components other than the polyolefin or the polyvinyl alcohol-based resin in the anchor coat layer 2 include polyolefins other than the above-described polyolefin, a silane coupling agent, organic titanate, polyacryl, polyesters, polyurethanes, polycarbonates, polyureas, polyamides, polyimides, melamine, phenol and the like.

The thickness of the anchor coat layer 2 is, for example, 1 μm or more and may be 2 μm or more and may be 5 μm or less. When the thickness of the anchor coat layer 2 is 1 μm or more, the unevenness on the surface of the paper base material 1 can be effectively filled, and it is possible to sufficiently and uniformly laminate the transparent vapor-deposited layer 3. On the other hand, when the thickness of the anchor coat layer 2 is 5 μm or less, it is possible to sufficiently and uniformly laminate each layer while suppressing the cost. The thickness of the anchor coat layer 2 means a value that is measured by the observation of a cut surface.

The anchor coat layer 2 can be formed by a step of applying a coating liquid containing the polyolefin or the polyvinyl alcohol-based resin and a solvent onto the surface of the paper base material 1 and then drying the coated film. Examples of the solvent include water, methyl alcohol, ethyl alcohol, isopropyl alcohol, n-propyl alcohol, n-butyl alcohol, n-pentyl alcohol, dimethyl sulfoxide, dimethyl formamide, dimethyl acetamide, toluene, hexane, heptane, cyclohexane, acetone, methyl ethyl ketone, diethyl ether, dioxane, tetrahydrofuran, ethyl acetate and butyl acetate. These solvent may be used singly or two or more thereof may be jointly used. Among these, methyl alcohol, ethyl alcohol, isopropyl alcohol, toluene, ethyl acetate, methyl ethyl ketone and water are preferable from the viewpoint of features. In addition, methyl alcohol, ethyl alcohol, isopropyl alcohol and water are preferable from the viewpoint of the environment.

[Overcoat Layer]

The overcoat layer 4 is provided on the surface of the transparent vapor-deposited layer 3 to be in contact with the transparent vapor-deposited layer 3. Similar to the anchor coat layer 2, the overcoat layer 4 is also preferably excellent in terms of flexibility. In such a case, it is possible to suppress the cracking of the transparent vapor-deposited layer 3 after the gas barrier laminate 10 is bent. Similar to the anchor coat layer 2, the overcoat layer 4 preferably contains a polyolefin having a polar group. The polyolefin that is contained in the overcoat layer 4 may be the same as or different from the polyolefin that is contained in the anchor coat layer 2.

The thickness of the overcoat layer 4 is, for example, 2 μm or more and may be 3 μm or more and is, for example, 10 μm or less and may be 8 μm or less or 5 μm or less. When the thickness of the overcoat layer 4 is 2 μm or more, the overcoat layer 4 is capable of sufficiently exhibiting a role of a heat seal layer. On the other hand, when the thickness of the overcoat layer 4 is 10 μm or less, it is possible to sufficiently exhibit the adhesiveness to the transparent vapor-deposited layer 3 or the barrier properties while suppressing the cost. The thickness of the overcoat layer 4 means a value that is measured by the observation of a cut surface.

<Packaging Bag>

Figure 2:
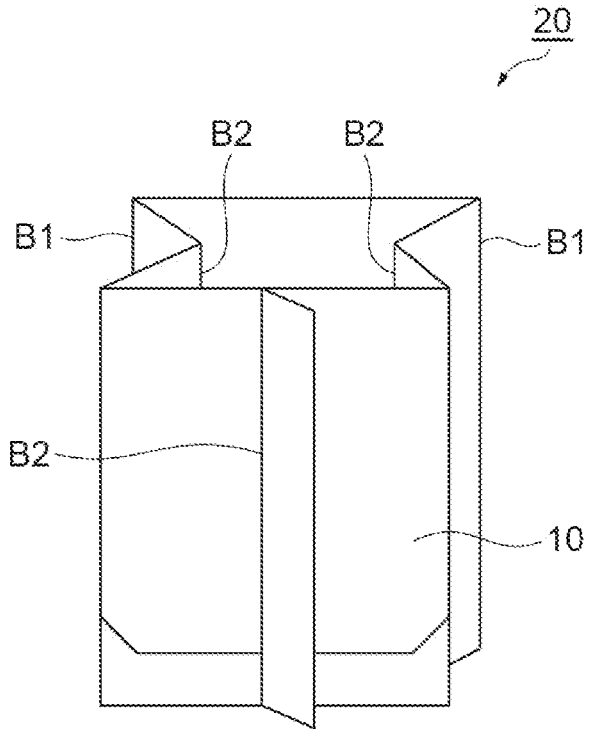
FIG. 2 is a perspective view schematically showing one embodiment of a packaging bag according to the present disclosure.

FIG. 2 is a perspective view showing one example (gusset bag) of a packaging body manufactured using the gas barrier laminate 10. A gusset bag 20 shown in this drawing has places where the gas barrier laminate 10 has been bent (bent parts B1 and B2). The bent part B1 is a place where the gas barrier laminate 10 forms a valley fold when seen from the innermost layer side, and, on the other hand, the bent part B2 is a place where the gas barrier laminate 10 forms a mountain fold when seen from the innermost layer side. A content is loaded into the gusset bag 20, and the top opening part is sealed, whereby the packaging body is manufactured. As the content, a content such as food or a pharmaceutical can be accommodated. Particularly, the packaging body is suitable for accommodating sweets or the like as food. The packaging bag according to the present embodiment is capable of maintaining high gas barrier properties in spite of having a shape with the bent parts.

Hitherto, the embodiment of the present disclosure has been described in detail, but the present invention is not limited to the embodiment. For example, in the present embodiment, an aspect in which the anchor coat layer 2 is provided between the paper base material 1 and the transparent vapor-deposited layer 3 has been exemplified, but the anchor coat layer 2 may not be provided depending on the use of the gas barrier laminate. In addition, in the present embodiment, an aspect in which the overcoat layer 4 is provided so as to cover the transparent vapor-deposited layer 3 has been exemplified, but the overcoat layer 4 may not be provided depending on the use of the gas barrier laminate, and a sealant layer (not shown) may be provided instead of the overcoat layer 4 to impart heat sealing properties.

In the embodiment, the gusset bag has been exemplified as one example of the packaging bag, but the packaging bag is not limited thereto. The packaging bag may be a bag provided with a bag shape by bending one gas barrier laminate so that the overcoat layer 4 faces each other, then, bending the gas barrier laminate as appropriate to form a desired shape and sealing the gas barrier laminate with heat or a bag provided with a bag shape by overlapping two gas barrier laminates so that the overcoat layers 4 face each other and then heat-sealing the gas barrier laminates. Specific examples other than the gusset bag include pillow bags, three-sided seal bags, and standing pouches.

The present disclosure relates to the following matters.

[1] A gas barrier laminate having a laminate structure including a paper base material and a transparent vapor-deposited layer, in which the paper base material has a maximum light transmittance of 0.85% or more for a light beam having at least one wavelength among light beams having a wavelength within a range of 300 nm to 800 nm.

[2] The gas barrier laminate according to [1], in which the paper base material is one selected from the group consisting of glassine paper, paraffin paper and parchment paper.

[3] The gas barrier laminate according to [1] or [2], further including an anchor coat layer provided between the paper base material and the transparent vapor-deposited layer, and an overcoat layer provided so as to cover the transparent vapor-deposited layer.

[4] The gas barrier laminate according to [3], in which the anchor coat layer has a thickness of 1 μm to 5 μm.

[5] The gas barrier laminate according to [3] or [4], in which the overcoat layer has a thickness of 2 μm to 10 μm.

[6] The gas barrier laminate according to any one of [1] to [5], in which the transparent vapor-deposited layer has a thickness of 30 nm to 100 nm.

[7] The gas barrier laminate according to any one of [1] to [6], in which the paper base material has a thickness of 30 μm to 100 μm, and a proportion of a thickness of the paper base material based on a total thickness of the gas barrier laminate is 70% or more.

[8] A packaging bag including the gas barrier laminate according to any one of [1] to [7].

[9] The packaging bag according to [8], further having a bent part.

EXAMPLES

Hereinafter, the present disclosure will be described in more detail based on examples, but the present invention is not limited to the following examples.

<Production of Gas Barrier Layer>

Experiment Example 1

As a paper base material, the following glassine paper was prepared.

Basis weight: 30.5 g/m$^2$

Clay coat layer: Absent

Thickness: 30 μm

A silica vapor-deposited layer (thickness: 30 nm) was formed on the surface of the glassine paper by vacuum vapor deposition. After that, an overcoat layer (thickness: 3 μm) was formed on the surface of the silica vapor-deposited layer as described below. That is, a coating liquid containing a salt of a carboxylic group (trade name: CHEMIPEARL S500, manufactured by Mitsui Chemicals, Inc.) was applied onto the surface of the silica vapor-deposited layer with a bar coater, and then a coated film was dried in an oven, thereby forming the overcoat layer. The physical properties of a gas barrier laminate according to the present example were as described below.

Total thickness: 33 μm

Proportion of thickness of paper base material: 91%

Proportion of mass of paper base material: 92 mass %

Experiment Example 2

A gas barrier laminate was produced in the same manner as in Experiment Example 1 except that the anchor coat layer was formed on the surface of the paper base material and the silica vapor-deposited layer was formed on the surface of the anchor coat layer. The anchor coat layer was formed as described below. That is, a coating liquid containing a salt of a carboxylic group (trade name: CHEMIPEARL S100, manufactured by Mitsui Chemicals, Inc.) was applied onto the surface of a glassine paper with a bar coater, and then a coated film was dried in an oven, thereby forming the anchor coat layer (thickness: 3 μm). The physical properties of the gas barrier laminate according to the present example were as described below.

Total thickness: 36 μm
Proportion of thickness of paper base material: 83%
Proportion of mass of paper base material: 85 mass %

Experiment Example 3

A gas barrier laminate was produced in the same manner as in Experiment Example 2 except that the thickness of the anchor coat layer was set to 1 μm instead of 3 μm. The physical properties of the gas barrier laminate according to the present example were as described below.
Total thickness: 34 μm
Proportion of thickness of paper base material: 88%
Proportion of mass of paper base material: 89 mass %

Experiment Example 4

A gas barrier laminate was produced in the same manner as in Experiment Example 2 except that the thickness of the anchor coat layer was set to 5 μm instead of 3 μm. The physical properties of the gas barrier laminate according to the present example were as described below.
Total thickness: 38 μm
Proportion of thickness of paper base material: 79%
Proportion of mass of paper base material: 81 mass %

Experiment Example 5

A gas barrier laminate was produced in the same manner as in Experiment Example 2 except that the thickness of the silica vapor-deposited layer was set to 100 nm instead of 30 nm. The physical properties of the gas barrier laminate according to the present example were as described below.
Total thickness: 36 μm
Proportion of thickness of paper base material: 83%
Proportion of mass of paper base material: 85 mass %

Experiment Example 6

A gas barrier laminate was produced in the same manner as in Experiment Example 2 except that the thickness of the overcoat layer was set to 2 μm instead of 3 μm. The physical properties of the gas barrier laminate according to the present example were as described below.
Total thickness: 35 μm
Proportion of thickness of paper base material: 86%
Proportion of mass of paper base material: 87 mass %

Experiment Example 7

A gas barrier laminate was produced in the same manner as in Experiment Example 2 except that the thickness of the overcoat layer was set to 10 μm instead of 3 μm. The physical properties of the gas barrier laminate according to the present example were as described below.
Total thickness: 43 μm
Proportion of thickness of paper base material: 70%
Proportion of mass of paper base material: 72 mass %

Experiment Example 8

A gas barrier laminate was produced in the same manner as in Experiment Example 2 except that the following glassine paper was used as the paper base material.
Basis weight: 40.0 g/m$^2$
Total thickness: 37 μm
Clay coat layer: Present
Thickness of clay coat layer: 5 μm
The physical properties of the gas barrier laminate according to the present example were as described below.
Total thickness: 43 μm
Proportion of thickness of paper base material: 74%
Proportion of mass of paper base material: 75 mass %

Experiment Example 9

A gas barrier laminate was produced in the same manner as in Experiment Example 2 except that the following glassine paper was used as the paper base material.
Basis weight: 60.0 g/m$^2$
Total thickness: 55 μm
Clay coat layer: Present
Thickness of clay coat layer: 5 μm
The physical properties of the gas barrier laminate according to the present example were as described below.
Total thickness: 61 μm
Proportion of thickness of paper base material: 82%
Proportion of mass of paper base material: 83 mass %

Experiment Example 10

A gas barrier laminate was produced in the same manner as in Experiment Example 2 except that the following glassine paper was used as the paper base material.
Basis weight: 70.0 g/m$^2$
Total thickness: 65 μm
Clay coat layer: Present
Thickness of clay coat layer: 5 μm
The physical properties of the gas barrier laminate according to the present example were as described below.
Total thickness: 71 μm
Proportion of thickness of paper base material: 92%
Proportion of mass of paper base material: 92 mass %

Experiment Example 11

A gas barrier laminate was produced in the same manner as in Experiment Example 2 except that the following coated paper was used as the paper base material.
Basis weight: 40.0 g/m$^2$
Total thickness: 36 μm
Clay coat layer: Present
Thickness of clay coat layer: 5 μm
The physical properties of the gas barrier laminate according to the present example were as described below.
Total thickness: 42 μm
Proportion of thickness of paper base material: 74%
Proportion of mass of paper base material: 75 mass %

Experiment Example 12

A gas barrier laminate was produced in the same manner as in Experiment Example 2 except that the following glassine paper was used as the paper base material.
Basis weight: 60.0 g/m$^2$
Total thickness: 55 μm
Clay coat layer: Present
Thickness of clay coat layer: 5 μm
The physical properties of the gas barrier laminate according to the present example were as described below.
Total thickness: 61 μm
Proportion of thickness of paper base material: 82%
Proportion of mass of paper base material: 83 mass %<

<Measurement of Light Transmittance of Paper Base Material>

The light transmittances of the paper base materials used in Experiment Examples 1 to 12 were measured.

Device: Spectrophotometer UV-2450 (manufactured by Shimadzu Corporation)

Wavelength range: 300 to 800 nm

Integrating sphere: Absent

Scan speed: Medium speed

Slit width: 5 nm

Number of times of measurement: 10 times

"Maximum light transmittance" shown in Tables 1 and 2 means the maximum value of the light transmittances of the paper base material within a wavelength range of 300 nm to 800 nm. In Tables 1 and 2, the average values of values obtained by 10 times of the measurement were entered.

The wavelength range where a light transmittance of 0.85% or more is exhibited means light wavelengths at which film thickness management is possible. That is, according to the present inventors' studies, it was clarified that, in the manufacturing processes of the gas barrier laminates according to Experiment Examples 11 and 12, it was difficult to perform film thickness measurement based on the light transmittances before and after the formation of the transparent vapor-deposited layer. That is, it was clarified from the measurement results of the light transmittances that, in a case where the value of the maximum light transmittance of the paper base material is small, this measurement value significantly varies. It is inferred that this variation is attributed to unevenness on the surface of the paper base material or the uneven distribution of a component in the paper base material.

Therefore, the degree of the variation in the measurement value of the maximum light transmittance of the paper base material was evaluated with the coefficient of variation CV that is calculated from the following equation.

$$\text{Coefficient of variation (CV)} = \sigma / \text{average value of maximum light transmittance of paper base material}$$

In the equation, "σ" is the standard deviation of the measurement values (N=10) of the maximum light transmittance of the paper base material, and "average value of maximum light transmittance of paper base material" is the average value of the measurement values (N=10) of the maximum light transmittance of the paper base material.

As a result, as shown in Table 2, the coefficients of variation of the maximum light transmittance of the paper base materials according to Experiment Examples 11 and 12 were 6.8 and 9.3, respectively. In contrast, the coefficients of variation of the maximum light transmittance of the paper base materials according to Experiment Examples 1 to 10 were within a range of 1.1 to 4.7. Based on the measurement results of the light transmittances of the paper base materials, Experiment Examples 11 and 12 were classified as the comparative examples, and Experiment Examples 1 to 10 were classified as the examples.

<Measurement of Water Vapor Permeability>

The water vapor permeabilities of the gas barrier laminates according to Experiment Examples 1 to 12 were measured by a MOCON method. As the measurement conditions, the temperature was set to 40° C., and the relative humidity was set to 90%. A crease was given to the gas barrier laminate while a 600 g roller was rotated at a speed of 300 mm/minute, and the water vapor permeability of the gas barrier laminate with the crease open was measured in the same manner. "Inward fold" in Tables 1 and 2 means a gas barrier laminate after the gas barrier laminate was made to form a mountain fold when seen from the paper base material side, and "outward fold" indicates a gas barrier laminate after the gas barrier laminate was made to form a valley fold when seen from the paper base material side. The results are shown in Tables 1 and 2.

TABLE 1

| | | Experiment Example 1 | Experiment Example 2 | Experiment Example 3 | Experiment Example 4 | Experiment Example 5 | Experiment Example 6 |
|---|---|---|---|---|---|---|---|
| Paper base material | Kind | Glassine paper | Glassine paper | Glassine paper | Glassine paper | Glassine paper | Glassine paper |
| | Basis weight ($g/m^2$) | 30.5 | 30.5 | 30.5 | 30.5 | 30.5 | 30.5 |
| | Thickness of clay coat layer (μm) | — | — | — | — | — | — |
| Anchor coat layer | Thickness (μm) | — | 3 | 1 | 5 | 3 | 3 |
| Transparent vapor-deposited layer | Material | SiOx | SiOx | SiOx | SiOx | SiOx | SiOx |
| | Thickness (nm) | 30 | 30 | 30 | 30 | 100 | 30 |
| Overcoat layer | Thickness (μm) | 3 | 3 | 3 | 3 | 3 | 2 |
| Maximum light transmittance (%) | | 16.8 | 16.8 | 16.8 | 16.8 | 16.8 | 16.8 |
| Wavelength range where a light transmittance of 0.85% or more is exhibited (nm) | | 300 to 800 | 300 to 800 | 300 to 800 | 300 to 800 | 300 to 800 | 300 to 800 |
| Coefficient of variation CV | | 1.1 | 1.1 | 1.1 | 1.1 | 1.1 | 1.1 |
| Classification | | Example | Example | Example | Example | Example | Example |
| Water vapor permeability ($g/m^2/d$) | Initial | 50.0 | 6.5 | 7.8 | 6.4 | 4.2 | 6.6 |
| | Inward fold | 110.0 | 7.6 | 8.0 | 6.6 | 7.3 | 7.1 |
| | Outward fold | 200.0 | 9.2 | 10.0 | 8.4 | 9.0 | 8.9 |

TABLE 2

| | | Experiment Example 7 | Experiment Example 8 | Experiment Example 9 | Experiment Example 10 | Experiment Example 11 | Experiment Example 12 |
|---|---|---|---|---|---|---|---|
| Paper base material | Kind | Glassine paper | Glassine paper | Glassine paper | Glassine paper | Coated paper | Glassine paper |
| | Basis weight ($g/m^2$) | 30.5 | 40.0 | 60.0 | 70.0 | 40.0 | 60.0 |
| | Thickness of clay coat layer (μm) | — | 5 | 5 | 5 | 5 | 5 |
| Anchor coat layer | Thickness (μm) | 3 | 3 | 3 | 3 | 3 | 3 |
| Transparent vapor-deposited layer | Material | SiOx | SiOx | SiOx | SiOx | SiOx | SiOx |
| | Thickness (nm) | 30 | 30 | 30 | 30 | 30 | 100 |
| Overcoat layer | Thickness (μm) | 10 | 3 | 3 | 3 | 3 | 3 |
| Maximum light transmittance (%) | | 16.8 | 2.8 | 1.1 | 0.9 | 0.08 | 0.03 |
| Wavelength range where a light transmittance of 0.85% or more is exhibited (nm) | | 300 to 800 | 300 to 800 | 620 to 800 | 750 to 800 | — | — |
| Coefficient of variation CV | | 1.1 | 2.3 | 2.6 | 4.7 | 6.8 | 9.3 |
| Classification | | Example | Example | Example | Example | Comparative Example | Comparative Example |
| Water vapor permeability ($g/m^2/d$) | Initial | 5.8 | 4.2 | 2.8 | 2.8 | 4.3 | 2.3 |
| | Inward fold | 8.1 | 7.4 | 6.9 | 5.3 | 5.8 | 3.5 |
| | Outward fold | 9.0 | 9.1 | 7.2 | 6.1 | 6.4 | 4.8 |

REFERENCE SIGNS LIST

1 Paper base material
2 Anchor coat layer
3 Transparent vapor-deposited layer
4 Overcoat layer
10 Gas barrier laminate
20 Gusset bag
B1 and B2 Bent part

The invention claimed is:

1. A gas barrier laminate having a laminate structure comprising:
a paper base material;
a transparent vapor-deposited layer;
an anchor coat layer provided between the paper base material and the transparent vapor-deposited layer; and
an overcoat layer provided so as to cover the transparent vapor-deposited layer,
wherein the paper base material has a maximum light transmittance of 0.85% or more for a light beam having at least one wavelength among light beams having a wavelength within a range of 300 nm to 800 nm, and
wherein the overcoat layer contains a polyolefin containing a salt of a carboxyl group, and wherein the anchor coat layer contains a polyvinyl alcohol-based resin.

2. The gas barrier laminate according to claim 1, wherein the paper base material is one selected from the group consisting of glassine paper, paraffin paper and parchment paper.

3. The gas barrier laminate according to claim 1, wherein the anchor coat layer has a thickness of 1 μm to 5 μm.

4. The gas barrier laminate according to claim 1, wherein the overcoat layer has a thickness of 2 μm to 10 μm.

5. The gas barrier laminate according to claim 1, wherein the transparent vapor-deposited layer has a thickness of 30 nm to 100 nm.

6. The gas barrier laminate according to claim 1,
wherein the paper base material has a thickness of 30 μm to 100 μm, and
a proportion of a thickness of the paper base material based on a total thickness of the gas barrier laminate is 70% or more.

7. A packaging bag including the gas barrier laminate according to claim 1.

8. The packaging bag according to claim 7, further comprising a bent part.

9. The gas barrier laminate according to claim 1, wherein the anchor coat layer contains a polyolefin having a polar group.

10. The gas barrier laminate according to claim 1, further comprising a coat layer provided between the anchor coat layer and the paper base material,
wherein the coat layer comprises at least one selected from the group consisting of a styrene-butadiene-based copolymer, a styrene-acrylic copolymer, an ethylene-vinyl acetate-based copolymer, a polyvinyl alcoholic resin, a cellulose-based resin, and paraffin, and has a thickness of 3 μm to 8 μm.

11. The gas barrier laminate according to claim 10, wherein the coat layer further comprises a filler comprising at least one selected from the group consisting of clay, kaolin, calcium carbonate, talc, and mica.

12. The gas barrier laminate according to claim 1, wherein the paper base material has a coefficient of variation of 1.1 to 4.7.

13. The gas barrier laminate according to claim 1, wherein the transparent vapor-deposited layer comprises at least one selected from the group consisting of silicon oxide, aluminum oxide, and a complex thereof.

14. The gas barrier laminate according to claim 1, wherein the paper base material has a basis weight of 20 $g/m^2$ to 100 $g/m^2$.

15. The gas barrier laminate according to claim 1, wherein a proportion of a mass of the paper base material based on a total mass of the gas barrier laminate is 50 mass % or more.

16. The gas barrier laminate according to claim 1, wherein the gas barrier laminate has a water vapor permeability of 10 $g/m^2/d$ or less at 40° C. and 90% RH.

17. The gas barrier laminate according to claim 1, wherein the gas barrier laminate has a water vapor permeability of 12

$g/m^2/d$ or less at 40° C. and 90% RH after a roller having a weight of 2 kg is rotated once on the gas barrier laminate bent with the paper base material placed outside.

18. The gas barrier laminate according to claim 9, wherein the polyolefin having a polar group in the anchor coat layer comprises a salt of a carboxyl group.

19. The gas barrier laminate according to claim 1, wherein the paper base material is glassine paper having a thickness of 30 μm to 100 μm and a basis weight of 30 $g/m^2$ to 70 $g/m^2$, the anchor coat layer comprises a polyolefin having a polar group and has a thickness of 1 μm to 5 μm, the transparent vapor-deposited layer comprises silicon oxide and has a thickness of 30 nm to 100 nm, the overcoat layer has a thickness of 2 μm to 10 μm, and a proportion of a mass of the paper base material based on a total mass of the gas barrier laminate is 80 mass % or more.

* * * * *